US005908380A

United States Patent [19]

Zavos et al.

[11] Patent Number: 5,908,380

[45] Date of Patent: Jun. 1, 1999

[54] COMPARTMENTALIZED ZAVOS SPERM SWIM-UP COLUMN

[76] Inventors: Panayiotis M. Zavos; Panayota N. Zavmaboupes-Zavos, both of 2413 Vince Rd., Nicholasville, Ky. 40356

[21] Appl. No.: 09/005,802

[22] Filed: Jan. 12, 1998

[51] Int. Cl.[6] ..... A61D 7/00

[52] U.S. Cl. ..... 600/33

[58] Field of Search ..... 600/33–35; 128/897–98; 604/403, 405, 406, 410, 906; 435/2

[56] References Cited

U.S. PATENT DOCUMENTS

| | | | |
|---|---|---|---|
| 3,894,529 | 7/1975 | Shrimpton | 600/35 |
| 4,759,344 | 7/1988 | Wang | 600/33 |
| 5,135,865 | 8/1992 | Ranoux | 600/33 |

*Primary Examiner*—John P. Lacyk
*Attorney, Agent, or Firm*—Don Halgren

[57] ABSTRACT

The invention relates to a sterile, disposable, compartmentalized Zavos swim-up column for the swimming-up of spermatozoa, at desired levels of dilution in a media, and a swimming down of spermatozoa into compartments within the column, as well as to a method for the harvesting of those semen samples having particular sperm morphology, motility, progressive motility, speed, sperm concentration, fertilization potential, and a sex ratio. The device comprises a hollow, vertically supported column, having a closed lower end, and an open upper end. A lowermost or first conical member is arranged at the lowermost end of the column, the lowermost conical member having a lowermost periphery in sealing engagement with the bottom of the column. The first conical member has inclined side walls and a truncated uppermost portion defining a peripheral edge which is open within into the column. A second conical member having a lowermost periphery is also attached to the side walls of the column in a sealing manner therebetween. The second conical member also has tapered walls and a truncated uppermost portion defining a peripheral edge which is open to the inside of the column. The area between the inclined walls of each of the conical members and the inner wall of the column define a periconical area which comprises a compartment for collecting sperm prior to harvesting thereof.

8 Claims, 2 Drawing Sheets

COMPARTMENTALIZED ZAVOS SPERM SWIM-UP COLUMN

BACKGROUND OF THE INVENTION

1. Field of the Invention

This invention relates to an apparatus and a method of processing semen and allowing its associated spermatozoa to become segregated to permit subsequent selection thereof, to increase the number of motile and morphological samples to be recovered therefrom.

2. Prior Art

A number of methods have been proposed for the processing of semen so as to increase its quality and quantity of spermatozoa population of a given semen sample. With improved quality and quantity of such spermatozoa, the probability of success of Artificial Insemination (AI), In Vitro Fertilization (IVF), Intracytoplasmic Sperm Injection (ICSI), and other related Assisted Reproductive Clinical Technologies (ARTs), may be improved. Some of the methodologies include washing and storage of the spermatozoa in media, and the "swim-up" procedure, a technique that takes advantage of the swimming abilities of a small percentage of spermatozoa within a given sperm population.

One attempt at the improvement of the collection of spermatozoa is shown in U.S. Pat. No. 3,894,529 to Shrimpton, entitled, "Method and Means For Controlling the Sex of Mammalian Offspring And Product Therefor". This patent discloses a method of separating X and Y sperm so as to control the sex of a desired offspring by inseminating an egg with an X or a Y sperm. The sperm is separated by applying a buoyant force to a mixture of sperm in the nutrient media so that the separation occurs according to the density of the sperm.

U.S. Pat. No. 4,759,344 To Wang, entitled, "Wang's Tubules For Sperm Preparations Used For IVF-ET-GIFT and Artificial Inseminations", discloses a method and an apparatus for separating sperm having the greatest motility. The sperm are allowed to swim upward in a column, where they may be collected to provide the strongest samples for insemination.

Processes such as these are relatively simple, however they are often inefficient and maybe susceptible to technician error and/or to laboratory variations.

Further, none of these techniques allow the use of the "swim-up/swim-down" principle nor do they permit selectivity based on the various characteristics such progressive motility, morphological characteristics, X or Y bearing sperm ratio and the like.

It is an object of the present invention, to provide a method in apparatus for the selection of a desired spermatozoa population from a given semen sample, to maximize the probability of success when that semen sample is utilized for artificial insemination, in vitro fertilization, intracytoplasmic sperm injection, and other related assisted reproductive clinical technologies.

It is yet a further object of the present invention, to provide a method and an apparatus that will minimize the likelihood of technical error and laboratory variations, and permit the selection of a particular population of spermatozoa.

It is yet still a further object of the present invention, to provide a method in apparatus to take advantage of the "swim-up/swim-down" principle and to permit the entrapment of various classifications of spermatozoa based on their various characteristics such as progressive motility, morphological characteristics, X or Y bearing sperm ratio and the like.

BRIEF SUMMARY OF THE INVENTION

The present invention relates to an apparatus and a method for processing semen and allowing its spermatozoa to be selectively sampled, permitting an increase in the number of motile and morphologically normal spermatozoa in the recovered fractions.

The apparatus comprises a generally vertically disposed, hollow column having a planar or flat lowermost end. The column defines a fluid-tight closure having an upper open end. A closure cap is removably securable to the open upper end of the column.

A first or a lowermost truncated conical member having a wide lowermost end and a narrower uppermost end is arranged at the bottom of the column. The first truncated conical member has a lowermost periphery which sealingly engages the lowermost side wall portion of the column, in a sealing relationship therewith. The walls of the first truncated conical member are arranged at an angle up between about 45 to about 60 degrees with respect to the longitude lower axis of the column. The area radially outwardly of the longitudinal axis and the tapered walls of the conical member is defined as the periconical area. The upper end of the truncated conical member is opened to the chamber defined by the interior walls of the column.

A second truncated conical member in a further embodiment, is arranged longitudinally above the lowermost conical member. The second conical member has a lowermost periphery that engages and is in a sealed relationship with the walls of the column. The second truncated conical member has an upper periphery through which it is open (it is open at both ends), to the chamber defined by the inside walls of the column. The area between the walls of the column and the outer side of the second conical member is defined as the periconical area or compartment number two. The lowermost periphery of the second truncated conical member is preferably disposed above the peripheral opening at the truncated portion of the first conical member.

A third and uppermost truncated conical member may be arranged in a mating relationship with the inside of the walls of the column, the widest portion of the conical member being in a sealed engagement with those inside walls of the column at a location spaced above the upper end of the second conical member. The third truncated conical member has an uppermost opening, which is opened to the inside of the chamber defined by the walls of the column. The space between the inside walls of the column and the tapered walls of the third truncated conical member is defined as the periconical area or compartment number three.

The area above each respective uppermost periphery or truncated portion of each conical member is defined as the epiconical area of its respective adjacent conical member. The first conical member is open only at its uppermost end. The second conical member and the third conical member are each open at both their lower and uppermost ends. Additional truncated conical members may be added in a manner similar to the second and third conical members, to increase the ability of the apparatus to discriminate farther and to improve its accuracy when it is deemed necessary.

The method of utilization of the present invention involves the placement of a semen specimen, (after it has been evaluated for volume, sperm count per milliliter, motility, and presence of debris), within the chamber defined by the lowermost conical member through its opened upper end. The upper surface of the semen sample should be brought to the same level as the upper periphery of the open end of the lowermost or first conical cylinder. Thereafter, a known volume of isolation media (i.e. "Ham's F-10") is drawn to fill the periconical and the epiconical areas of the first conical member, if only one such member is utilized within the column, or into the epiconical area of the second and third conical members, or more, depending on the number of conical members used within the inventive device. The isolation media must at least be filled above the lip of the upper end of the particular conical member over which the sperm is expected to swim to permit the "swim-up/swim-down" process to occur. The column then has a closure cap that may be then gently placed thereon, and the column and its contents are allowed to sit in a controlled environment for about a period of time, (for example, about one hour).

During that period of time, healthy, motile spermatozoa gradually rise or swim up from the holding chamber within the lowermost or first conical member, through the media, and into the epiconical area of that first conical member. Certain spermatozoa will subsequently swim down into the periconical area (the first compartment) into the media surrounding the lowermost or first conical member.

Certain spermatozoa specimens will gradually rise and swim-up through the upper end of the second conical member and other spermatozoa specimens will swim-up through the upper end of the third (or higher) conical member. Certain of such specimens will settle in particular periconical areas between the walls of the middle or second conical member and the column, and the walls of the third (or higher) conical member and the inside wall of the column, (if more than one such conical member is used), each respective "compartment" or periconical area each defining a reservoir for a particular characteristic spermatozoa therewithin.

At the end of this gradual-rise period, the over-layer of the media in and around the top of the semen and within the respective conical members for each individual compartment, is removed. The particular spermatozoa entrapped in the media within that/those periconical areas (compartments) are used for further cases of assisted reproductive technologies. Such harvesting or removal of the spermatozoa/media from the compartments within the column at the end of the incubation period is done by placing a harvesting instrument, such as a needle with a syringe, or a pipette, into the respective periconical areas of each conical member, and gently aspiring the media until almost all of the overlayed media is removed each time. The gradual-rise specimen for each compartment may be used at the desired level of dilution in a media of choice, in a centrifuge operation. The level of sperm dilution, or the sperm concentration in the resuspended preparation, shall be determined by the clinical reproductive purpose for that particular spermatozoa. Such gradually-risen spermatozoa may be thus utilized for In Vitro Fertilization (IVF), Artificial Insemination (AI), Intrauterine Insemination (IUI), Gamete Intra-Fallopian Transfer (GIFT), Zygote Intra-Fallopian Transfers (ZIFT), Intra-Cytoplasmic Sperm Injection (ICSI), sex selection (shifting the sex ratio via the use of an X or Y bearing sperm fraction) and other similar or related clinical assisted reproductive procedures or technologies.

Thus the invention comprises a sterile, disposable, compartmentalized Zavos swim-up column for the swimming-up/swimming-down of spermatozoa, at desired levels of dilution in a media, for the production of semen samples having particular sperm morphology, motility, sperm concentration, fertilization potential, and a sex ratio, comprising a hollow, vertically supported column, having a closed lower end, and an open upper end. A lowermost or first conical member is arranged at the lowermost end of the column. The lowermost conical member has a lowermost periphery in sealing engagement with the lowermost end of the column. The first conical member has inclined side walls and a truncated uppermost portion defining a peripheral edge opening within the column.

A second conical member having a lowermost periphery is attached to side walls of said column in a sealing manner therebetween. The second conical member has tampered walls and a truncated uppermost portion defining a peripheral edge. The second conical member is open to the inside of said column. The area between the inclined walls of the conical members, and the inner walls of the column define a periconical area that comprises a compartment for collecting sperm prior to harvesting thereof. A sealable cap is arranged to close the open end of the column. A further conical member is arranged within the column, the further conical member defining a further periconical compartment or area between the inclined walls of the conical member and the walls of the column, for the collection of sperm therein, until harvesting thereof.

The invention includes a method for the collection and harvesting of sperm samples of several varying characteristics, may comprise the steps of providing a column having a closed lower end and an open upper end, placing a first truncated conically shaped member at the lower end of the column, placing a second truncated conically shaped member in the column, above the first conically shaped member, depositing a sample of sperm within the column, within the first conically shaped member, filling the column with an isolation media to a level above the upper edge of the second truncated conically shaped member, permitting the sperm to swim up through the media about the conical member and to swim down into a periconical compartment between one of the conical members and the walls of the column, and inserting a harvesting device to withdraw media and certain sperm from a periconical compartment outwardly of one of the conical members. The method may include the steps of inserting a harvesting device to withdraw media and certain sperm from a further periconical compartment outwardly of a further one of the conical members, arranging a third truncated conically shaped member within the column, longitudinally above the second conically shaped member; and filling the isolation media to a level above the uppermost edge of the third conically shaped member, to provide sperm within the first conically shaped member yet a further compartment in which to swim up and swim down into. Additional conically shaped members may be placed in the column, on top of and spaced from the third truncated conical member in a similar configuration to the second and third conical members, to increase the ability of the apparatus to further discriminate and improve its accuracy in selecting higher quality sperm whenever deemed necessary.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENTS

Figure 1:
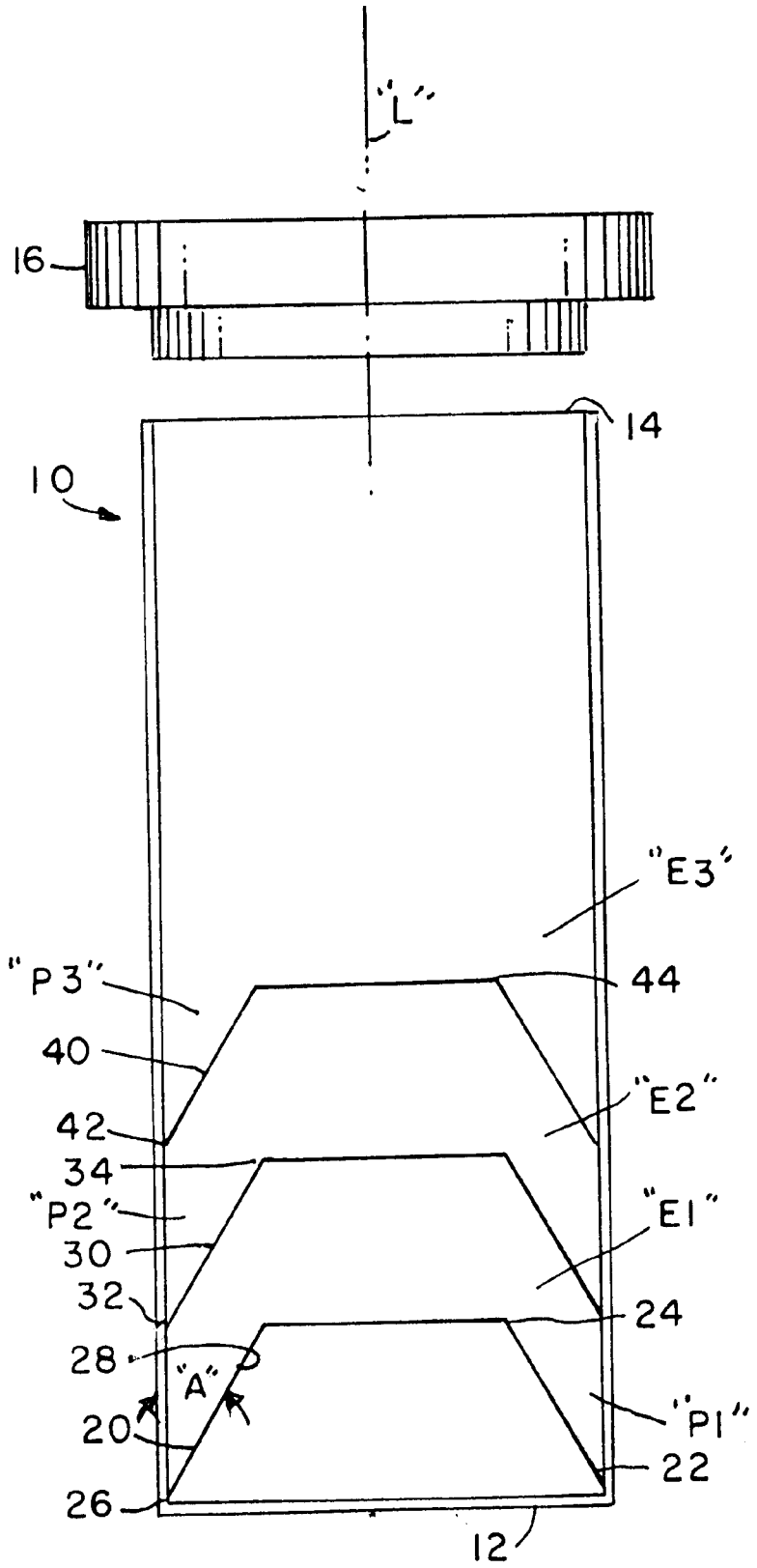
FIG. 1 is a side elevational view, in section, of a Zavos type swim-up column constructed according to the principles of the present invention.

Referring now to the drawings in detail, and particularly to FIG. 1, there is shown the present invention relates to an apparatus and a method for processing semen and allowing its spermatozoa to be selectively sampled, permitting an increase in the number of motile, progressively motile and morphologically normal spermatozoa in the recovered fractions.

The apparatus comprises a generally vertically disposed, hollow column 10 having a planar or flat lowermost end 12. The column 10 defines a fluid-tight closure having an upper open end 14. A closure cap 16 is removably securable to the open upper end 14 of the column 10.

A first or a lowermost truncated conical member 20 having a wide lowermost end 22 and a narrower uppermost end 24 is arranged at the bottom 12 of the column 10. The first truncated conical member 22 has a lowermost periphery 26 which snuggly engages the lowermost inner sidewall portion of the column 10, in a sealing relationship therewith. The walls 28 of the first truncated conical member 20 are arranged at an angle "A" of between about 45 to about 60 degrees with respect to the longitudinal axis "L" of the column 10. The area radially outwardly of the longitudinal axis and outwardly of the tapered walls 28 of the first conical member 20 and within the walls of the column 10 is defined as the periconical area "P1". The upper end 24 of the first truncated conical member 20 is opened to the chamber defined by the interior walls of the column 10, the area thereabove being defined as its epiconical area "E1".

A second truncated conical member 30 in a further embodiment, may be arranged longitudinally above the lowermost conical member 20, as shown in FIG. 1. The second conical member 30 has a wide lowermost peripheral portion 32 that engages and is in a sealed relationship with the walls of the column 10. The second truncated conical member 30 has an upper peripheral portion 34 through which it is open (open at both ends), to the chamber defined by the inside walls of the column 10. The area between the walls of the column 10 and the outer side of the second conical member 30 is defined as the periconical area "P2", as compartment number two. The lowermost periphery 32 of the second truncated conical member 30 is preferably disposed above the peripheral opening 24 at the truncated portion of the first conical member 20, designated "E1".

A third and uppermost truncated conical member 40 is arranged in a mating relationship with the inside of the walls of the column 10, as shown on FIG. 1, the lowest and widest periphery 42 of the third conical member 40 is in a sealed engagement with those inside walls of the column 10 at a location spaced above the upper end 34 of the second conical member 30. The third truncated conical member 30 has an uppermost opening 44, which is opened to the inside of the chamber defined by the walls of the column 10. The space between the inside walls of the column 10 and the tapered walls 46 of the third truncated conical member 40 is defined as the periconical area "P3" for compartment number three.

The area above each respective uppermost periphery or truncated portion of each conical member is defined as the epiconical area E1, E2 and E3, for its respective adjacent conical member 20, 30 and 40, respectively. The first conical member 20 is open only at its uppermost end 24. The second conical member 30 and the third conical member 40, and any additional such members, are each open at both their lower and uppermost ends.

Figure 2:
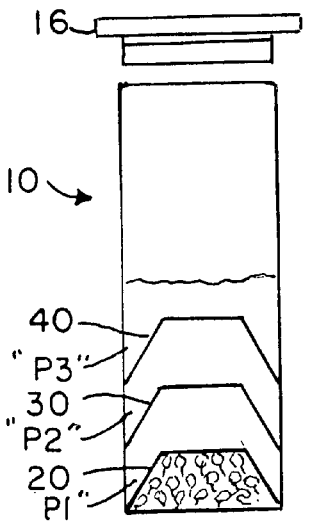
FIG. 2 is a view similar to FIG. 1, showing placement of a sample of sperm in the bottom of a cylinder.
Figure 3:
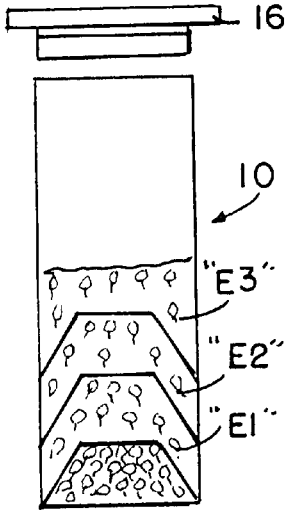
FIG. 3 is a view similar to FIG. 2, showing the gradual-rise of the sperm over a period of time.
Figure 4:
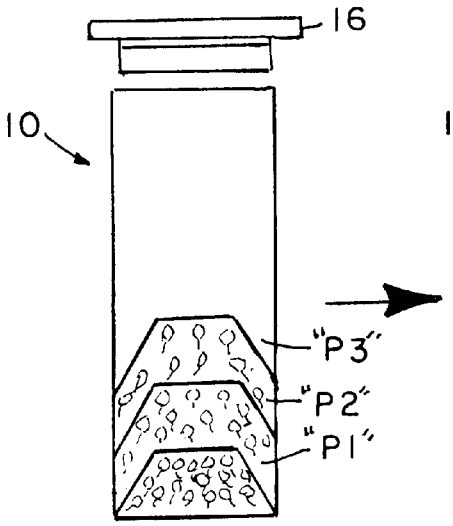
FIG. 4 is a view similar to FIG. 3, showing a harvesting of sperm from a top compartment.
Figure 5:
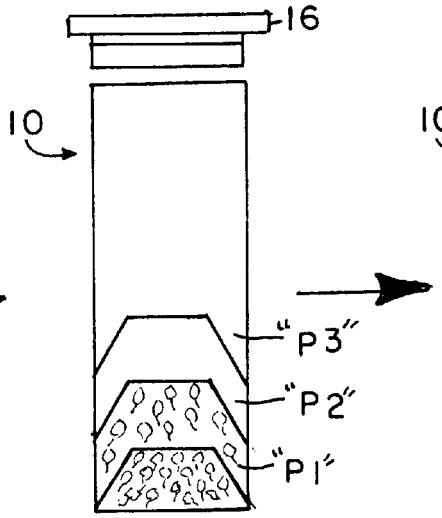
FIG. 5 is a view similar to FIG. 4, showing a harvesting of sperm from an intermediate compartment.
Figure 6:
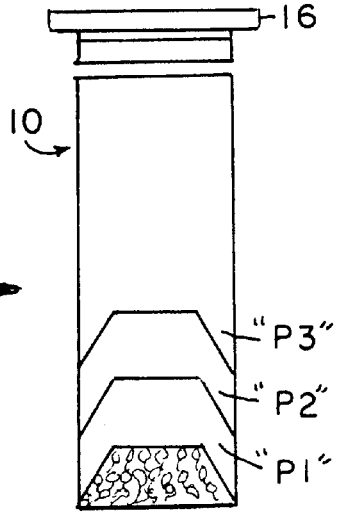
FIG. 6 is a view similar to FIG. 5, showing a harvesting of sperm from a lower

The method of utilization of the present invention involves the placement of a semen specimen, (after it has been evaluated for volume, sperm count per milliliter, motility, and presence of debris), within the chamber defined by the lowermost conical member 20 through its opened upper end 24. The upper surface of the semen sample should be brought to the same level as the upper periphery of the open end 24 of the lowermost or first conical member 20, as may be seen in FIG. 2. Thereafter, a known volume of isolation media (i.e. "Ham's F-10") is drawn to fill the periconical and the epiconical areas of the second and third conical members 30 and 40, and slightly above, as may be seen in FIG. 3. The column 10 then has a closure cap 16, which is then gently placed thereon, and the column 10 and its contents are allowed to sit in a controlled environment for a set period of time, (for example, about one hour). In any case, the time set will be proportional to the number and quality of sperm in the semen to be processed.

During that period of time, healthy, motile spermatozoa gradually rise or swim up from the holding chamber within the lowermost or first conical member 20, through the media, and into the epiconical area "E1", of that first conical member. Certain spermatozoa will subsequently swim down into the periconical area (the first compartment P1) into the media surrounding the lower-most or first conically shaped member.

Certain spermatozoa specimens will gradually rise and swim-up through the upper end of the second conical member and other spermatozoa specimens will swim-up through the upper end of the third conical member. Certain of such specimens will settle in particular periconical areas between the walls of the middle or second conical member and the column, and the walls of the third cone member and the inside wall of the column, each respective "compartment" or area each defining a reservoir for a particular class of spermatozoa therewithin.

At the end of this gradual-rise period, the over-layer of the media in and around the top of the semen and within the respective conical members for each individual compartment, is removed. The particular spermatozoa entrapped in the media within those periconical areas (compartments) are used for further cases of assisted reproductive technologies. Such harvesting or removal of the spermatozoa/media from the column at the end of the incubation period is done by placing a harvesting instrument, such as a needle with a syringe, or a pipette into the respective periconical areas (P3, P2 and P1) of each compartment, and gently aspiring the media until almost all of the overlayed media is removed each time. The gradual-rise specimen for each compartment may be used at the desired level of dilution in a media of choice, in a centrifuge operation. The level of sperm dilution, or the sperm concentration in the resuspended preparation, shall be determined by the clinical reproductive purpose for that particular group of spermatozoa. Such gradually-risen spermatozoa may be thus utilized for In Vitro Fertilization (IVF), Artificial Insemination (AI), Intrauterine Insemination (IUI), Gamete Intra-Fallopian Transfer (GIFT), Zygote Intra-Fallopian Transfers (ZIFT), Intra-Cytoplasmic Sperm Injection (ICSI), sex selection (shifting the sex ratio via the use of an X or Y bearing sperm fraction) and other assisted reproductive clinical procedures.

We claim:

1. A sterile, disposable, compartmentalized Zavos swim-up column for the swimming-up of spermatozoa, at desired levels of dilution in a media, for the production of semen samples having particular sperm morphology, motility, progressive motility, speed, sperm concentration, fertilization potential, and a sex ratio, comprising:

a hollow, vertically supported column, having a closed lower end, and an open upper end; and a lowermost or first conical member arranged at the lowermost end of said column, said lowermost conical member having a lowermost periphery in sealing engagement with the lowermost end of said column, said first conical member having inclined side walls and a truncated uppermost portion defining a peripheral edge and opened within said column; said area between said inclined walls of said conical members and said inner walls of said column defining a periconical area which comprises a compartment for collecting sperm prior to harvesting thereof.

2. A sterile, disposable, compartmentalized Zavos swim-up column, as recited in claim 1, including a second conical member having a lowermost periphery attached to side walls of said column in a sealing manner therebetween, said second conical member having tapered walls and a truncated uppermost portion defining a peripheral edge and open to the inside of said column, said area between said inclined walls of said conical members, and said inner walls of said column defining a periconical area which comprises a compartment for collecting sperm prior to harvesting thereof.

3. A sterile, disposable, compartmentalized Zavos swim-up column, as recited in claim 1, including:

a sealable cap arranged for closing said open end of said column.

4. A sterile, disposable, compartmentalized Zavos swim-up column, as recited in claim 2, including:

a further conical member arranged within said column, said further conical member defining a further periconical compartment or area between said inclined walls of said conical member and the walls of said column, for the collection of sperm therein, until harvesting thereof.

5. A method for the collection and harvesting of sperm samples of several varying characteristics, comprising the steps of:

providing a column having a closed lower end and an open upper end;

placing a first truncated conically shaped member at said lower end of said column;

depositing a sample of sperm within said column within said first conically shaped member;

filling said column with an isolation media above the upper edge of said truncated conically shaped member;

permitting said sperm to swim up through said media about said conical member and to swim down into a periconical compartment between of said conical members and the walls of said column; and inserting a harvesting device to withdraw media and certain sperm from a periconical compartment outwardly of said conical member.

6. The method for the collection and harvesting of sperm samples of several varying characteristics as recited in claim 5, including the step of:

placing a second truncated conically shaped member in said column, above said first conically shaped member.

7. The method for the collection and harvesting of sperm samples of several varying characteristics as recited in claim 5, including the step of:

inserting a harvesting device to withdraw media and certain sperm from a further periconical compartment outwardly of a further one of said conical members.

8. The method for the collection and harvesting of sperm samples of several varying characteristics as recited in claim 6, comprising the steps of;

arranging a third truncated conically shaped member within said column, above said second conically shaped member; and filling said isolation media above the uppermost edge of said third conically shaped member, to provide sperm within said first conically shaped member yet a further compartment in which to swim up and swim down into.

* * * * *